US007533473B2

(12) United States Patent
Chua

(10) Patent No.: US 7,533,473 B2
(45) Date of Patent: May 19, 2009

(54) IN-SITU SHEAR WALL NAILING TEMPLATE

(76) Inventor: Bryan S. M. Chua, 1628 Fulton St., San Francisco, CA (US) 94117

( * ) Notice: Subject to any disclaimer, the term of this patent is extended or adjusted under 35 U.S.C. 154(b) by 0 days.

(21) Appl. No.: 11/713,194

(22) Filed: Mar. 1, 2007

(65) Prior Publication Data

US 2008/0209749 A1 Sep. 4, 2008

(51) Int. Cl.
*G01B 3/10* (2006.01)

(52) U.S. Cl. ..... 33/758; 33/759; 33/679.1

(58) Field of Classification Search ..... 33/758, 33/759, 760, 563, 564, 565, 566, 679.1
See application file for complete search history.

(56) References Cited

U.S. PATENT DOCUMENTS 2,187,087 A * 1/1940 Leary ..... 33/758
4,149,320 A * 4/1979 Troyer et al. ..... 33/758
5,012,590 A * 5/1991 Wagner et al. ..... 33/759
5,627,763 A * 5/1997 Carlson ..... 33/758
5,950,321 A * 9/1999 Pena et al. ..... 33/758
6,317,996 B1 * 11/2001 Myers et al. ..... 33/566
6,397,487 B1 * 6/2002 Welch et al. ..... 33/759
7,373,731 B2 * 5/2008 Nyberg ..... 33/566
2002/0148134 A1 * 10/2002 Meyer et al. ..... 33/758
2006/0096112 A1 * 5/2006 Berring ..... 33/759

* cited by examiner

*Primary Examiner*—G. Bradley Bennett
(74) *Attorney, Agent, or Firm*—Imperium Patent Works LLP; T. Lester Wallace

(57) ABSTRACT

A non-structural shear wall nailing template bears a pattern of shear wall nailing pattern markings. The template is made of an inexpensive sheeting material that will not interfere with the further construction of the building if the template remains in-situ after construction of the shear wall. In one example, the template is a strip. The strip bears lettering that indicates the type of nailing pattern to which the nailing pattern markings conform. After fixing the template to one or more sheathing panels such that the template is aligned in a predefined way with respect to framing members behind the panel(s), nails are driven at the locations of the markings on the template. By driving a nail at the location of each template marking, the shear wall is constructed with proper nail spacing. A set of templates is provided to facilitate nailing in different shear wall nailing patterns.

23 Claims, 2 Drawing Sheets

IN-SITU SHEAR WALL NAILING TEMPLATE

TECHNICAL FIELD

The disclosed embodiments relate to the construction and nailing of shear walls.

BACKGROUND INFORMATION

A shear wall is a wall that typically includes braced sheathing panels (also known as shear panels) nailed to framing members and an associated set of hold-downs. The shear wall counters the effects of lateral loads. When building a shear wall, structural plywood or particle-board sheathing panels are typically applied to cover wood stud framing. A nail gun is then typically used to nail the panels to the underlying framing in a specified nailing pattern. The particular pattern is important and is specified by a structural engineer.

One of several methods may be used to construct a shear wall in the field. In one method, the appropriate lengthwise (vertical) spacings between nails are measured and the nail locations are manually marked with a pencil. The marks on the sheathing are then used to place nails during the nailing operation. The manual pencil marking is time consuming. Moreover, the nails are to be properly spaced in not just one dimension (the lengthwise or vertical dimension), but rather are also to be properly spaced offset from the edge of the sheathing (the horizontal dimension). Typically the nails are specified to be spaced a certain distance from the edges of the sheathing panels or from edges of the underlying framing members, depending on the nailing pattern and nailing density specified. Sometimes a chalk line is used to accomplish this horizontal marking. Often, however, the extra trouble of using a chalk line is dispensed with and the horizontal spacing of the nails is just "eyeballed". Due to this eyeballing, the horizontal spacing of the nails may be irregular and imprecise.

In a second method, no marking whatsoever is performed. The individual with the nail gun simply "eyeballs" both the vertical and horizontal placement of each nail at the time of nailing and then drives the nail using the nail gun. The resulting spacing of nails is therefore not always precise. The person doing the nailing may intend to place nails with a specified three inch vertical spacing, but when the spacing between the actual nails as placed is measured, the spacing may be four inches in places.

SUMMARY INFORMATION

A non-structural shear wall nailing template bears a pattern of shear wall nailing pattern markings. The template may, for example, be made of paper, mylar, or other printable substrate. In one example, the pattern is a "field" nailing pattern and the template also bears a second pattern. The second pattern is an "edge" nailing pattern. The template bears lettering (numerals and/or lettering and/or a symbol) that indicates the type of nailing pattern that the nailing pattern markings conform to. If, for example, the nailing pattern markings are for the nailing of a "type 3 shear wall", then the lettering on the template might be a "3". If, for example, the nailing pattern markings are for the nailing of a "type 4 shear wall", then the lettering on the template might a "4".

In one example, a very long length (for example, one hundred feet) of the template material is rolled into a roll. Such rolls are sold at the retail level. An individual who is constructing a shear wall in the field separates a length of the template material from such a roll to form the template. The length may, for example, be torn from the roll by hand without the use of any cutting tool. Alternatively, the length can be cut from the roll using a scissors or box cutter or knife or serrated edge or another suitable cutting implement. Alternatively, the length can be extended from a roll and then cut off from the roll using an ordinary handheld packing tape dispenser.

The template is then fixed to one or more sheathing panels that are to be nailed to framing members in accordance with a specified nailing pattern. The template may include an adhesive layer that is usable to fix the template in place to the sheathing panel(s). The template may be tacked in place using a few nails or staples. The template is fixed to the sheathing panel(s) such that the template is aligned in a pre-defined way with respect to a framing member behind the sheathing panel(s).

A different nail is then driven through the template at each different marking location of the pattern on the template. Each such nail is driven through the template, then through the sheathing panel, and then into the framing member. By driving a nail at the location of each marking on the template, the shear wall is constructed with proper nailing spacing. The manual measuring and pencil marking described above in the background information section can be avoided. The eyeballing described above in the background information section can be avoided.

The nailing template is made of a lightweight inexpensive non-structural material and need not be removed once construction of the shear wall has been completed. The template may, for example, be made of inexpensive and lightweight paper or mylar or another suitable inexpensive sheeting material that will not interfere with the further construction of the building if the template is not removed.

This summary does not purport to define the invention. The invention is defined by the claims.

DETAILED DESCRIPTION

Figure 1:
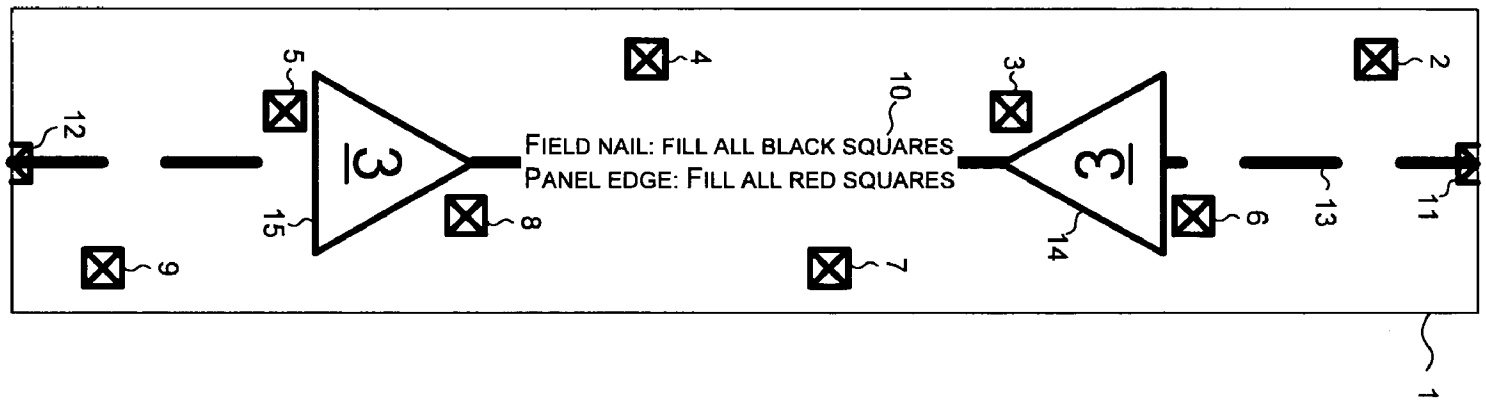
FIG. 1 is a diagram of a shear wall nailing template in accordance with one novel aspect.

FIG. 1 shows a lightweight non-structural shear wall nailing template 1 in accordance with one novel aspect. Template 1 is a strip at least five feet in length. Template 1 preferably has a uniform width of between one inch and eight inches wide. The template material is therefore referred to here as "tape".

In the specific example illustrated, template 1 is a portion of a roll of a one hundred foot length of tape, where the tape is two and one half inches wide. The one hundred foot roll of tape weighs less than one hundred sixty ounces (five pounds). The tape is made of an inexpensive, flexible, non-metallic, lightweight non-structural material (for example, paper or mylar or polyester) through which standard nails used in making shear walls can be easily driven using hand tools. The tape material is such that the tape can be cut easily with ordinary box cutters or scissors or a knife or a serrated edge such as that found on a typical packaging tape dispenser. In one embodiment, lengths of the non-structural template tape material can be torn from the roll by hand without the use of box cutters or scissors or any other tool. Template 1 may, for example, include an adhesive layer on one side such that the template strip can adhere to ordinary plywood or particleboard sheathing material. Template 1 may involve two layers where one of the layers is a disposable backing layer. When the backing layer is removed, an adhesive side of the other layer is exposed.

There are two sets of nailing pattern markings on template 1. The markings are printed on the template tape material. The markings of the first set of nailing pattern markings are denoted 2-9. This first set of markings is to be used when template 1 is used to determine nail placement at edges of panels. Instructional lettering 10 corresponds to the first set of nailing pattern markings. The instructional lettering 10 states "PANEL EDGE: FILL ALL RED SQUARES". The markings of the first set are colored red so that the markings of the first set can be visually distinguished from markings of the second set.

Markings of the second set of nailing pattern markings are denoted 11 and 12. Instructional lettering 13 corresponds to the second set of nailing pattern markings. Instructional lettering 13 states "FIELD NAIL: FILL ALL BLACK SQUARES". The markings of the second set are colored black so that the markings of the second set can be visually distinguished from markings of the first set.

In addition to the first and second sets of nailing pattern markings, template 1 bears a heavy dashed centerline marking 13 as illustrated in FIG. 1. Centerline marking 13 is usable to place and align template 1 properly with respect to a vertical joint between abutting plywood panels, or with respect to a vertical line such as a chalk line or a line of nails.

In addition, template 1 includes an indication of a particular nailing pattern to which to the markings on the template conform. One nailing pattern is commonly referred to as a "3" and the associated type of shear wall is commonly referred to as a "3 shear wall". The numeral "3" lettering (the term "lettering" here is used to denote numerals and/or letters and/or symbols) in the triangular symbols 14 and 15 indicate that the nailing pattern marked on template 1 is the nailing pattern used to make a "3 shear wall". The "3" is referred to as the nailing pattern type. In the "3" nailing pattern type, edge nail markings disposed along the same sheathing panel are separated by three inches and alternate between two vertical lines. Marks 2 and 3 are, for example, separated by a distance of three inches. Marks 2 and 4 are, for example, disposed along the same vertical line and are separated by six inches (three inches twice). Similarly, marks 3 and 5 are disposed along the same vertical line and are separated by six inches. Marks 7 and 9 are disposed along the same vertical line and are separated by six inches. Marks 6 and 8 are disposed along the same vertical line and are separated by six inches. The staggering of the markings in both the vertical and horizontal dimensions is as specified by the "3 shear wall" specification.

Figure 2:
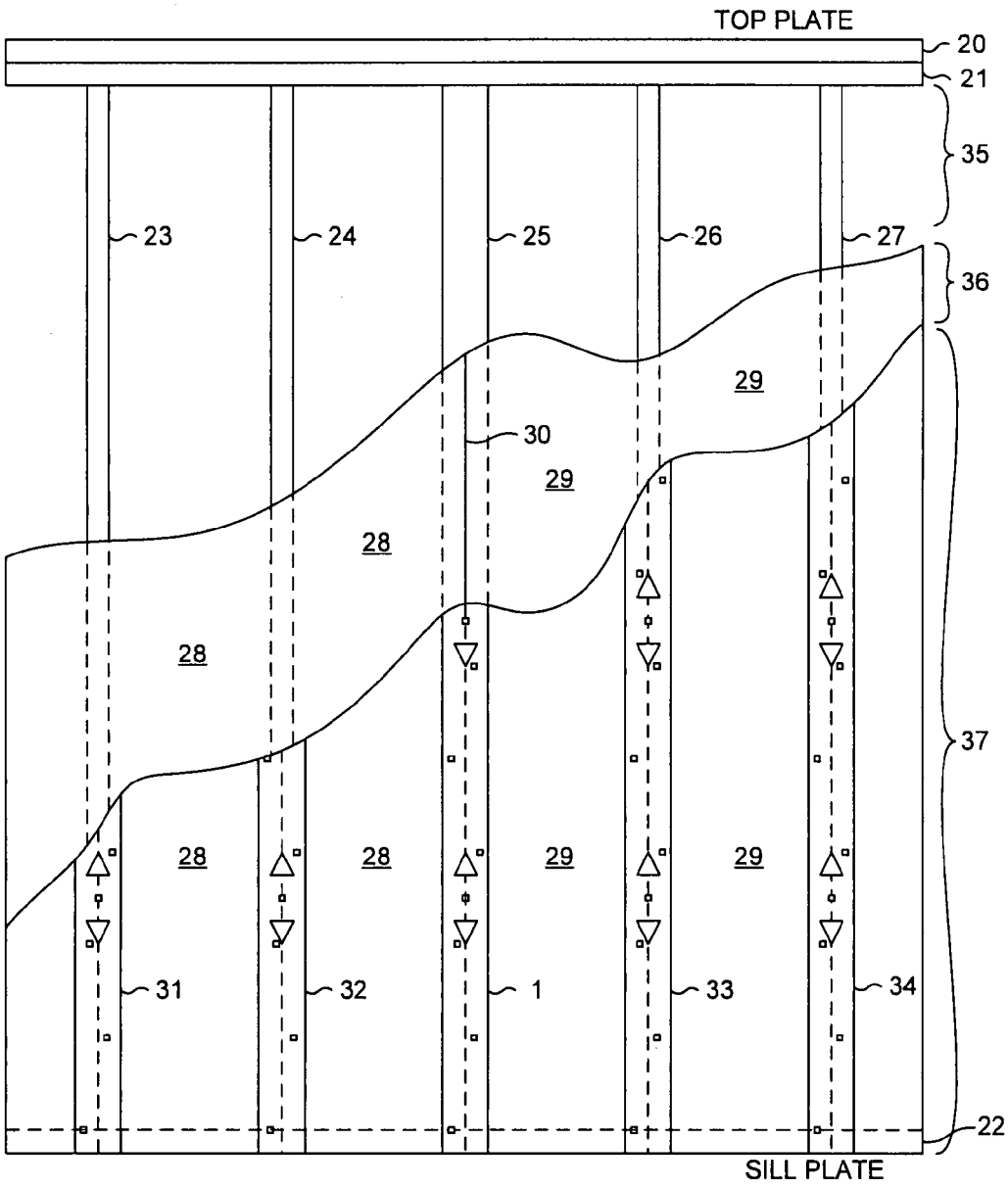
FIG. 2 is a diagram that illustrates one example of how the shear wall nailing template of FIG. 1 can be used in the making of a shear wall.

FIG. 2 is a diagram that illustrates a method of using template 1 of FIG. 1. A frame includes horizontal framing members 20-22 and vertical framing members 23-27. Vertical framing members 23, 24, 26 and 27 are, in this specific example, 2×4 wood studs that are pictured on edge in the diagram. Framing members 23, 24, 26 and 27 are approximately one and half inches wide as viewed in FIG. 2. Framing member 25 is a 3×4 wood stud. The side of framing member 25 that is seen in FIG. 2 is the side of member 25 that is approximately two and one half inches wide.

Two standard four foot by eight foot plywood or particleboard sheathing panels 28 and 29 (also referred to as "siding panels") are oriented edge-to-edge such that the large face-sides of the panels are disposed in the plane of the page in the illustration of FIG. 2. Line 30 illustrates the vertical boundary between the two abutting edges of panels 28 and 29. These two sheathing panels are to be nailed to the framing members to make the shear wall. In a first step, the two panels are tacked in place with a few holding nails. Rather than abutting one another, the two sheathing panels may actually be separated by a small specified gap.

Next, five template strips 31, 32, 1, 33 and 34 of the novel template strip tape material are attached to the front side of the sheathing panels 28 and 29 as illustrated. Each of the templates is an eight foot piece taken from the same roll of the template strip material. If templates 31, 32, 1, 33 and 34 are self-adhesive and have an adhesive on one side, then the adhesive holds the templates to the sheathing panels. Alternatively, templates are tacked in place with a few holding nails or staples.

Next, templates 31, 32, 1, 33 and 34 are used in the nailing process. Templates 31 32, 33 and 34 are disposed over framing members 23, 24, 26 and 27 as illustrated. These templates are not aligned along edges of the panels. The nails in these portions of the shear wall are therefore said to be in the "field" of the panels. Nails are therefore placed using the "field" nailing pattern of nail markings (see FIG. 1). Which markings are the field markings and which markings are the edge markings are designated by the instructional lettering on the template strips. A nail is driven through each of the field nailing markings in templates 31, 32, 33 and 34 such that the nail extends through the template, then through the sheathing, and then into the framing member behind the sheathing. The markings used are illustrated in FIG. 2 as solid black markings.

Template 1, however, is disposed over the rightmost edge of panel 28 and over the leftmost edge of panel 29. The centerline 13 of template 1 is aligned over the boundary 30 between the two panels 28 and 29 as illustrated in FIG. 2. This template 1 is not disposed in the "field" of the panels, but rather is disposed along edges of the panels. The pattern of nails to be used in the nailing process is therefore said to be an "edge pattern". Nails are therefore placed using the "panel edge" pattern of markings (see FIG. 1). A nail is driven through each of the panel edge markings in template 1 at a specified distance from an edge of the sheathing. The nail passes through the template 1, then through the sheathing, and then into the framing member 25 behind the sheathing. The markings used are illustrated in FIG. 2 as solid black markings.

FIG. 2 shows the structure of the framing in the cutaway portion 35 at the top of the diagram. FIG. 2 also shows a cutaway portion 36 of how the structure would look with the sheathing applied but before the templates 31, 32, 1, 33 and 34 are applied. The vertical dashed lines in cutaway portion 36 indicate where the framing members are located behind the sheathing. Cutaway portion 37 of FIG. 2 shows the structure after the templates 31, 32, 1, 33 and 34 have been applied to the surface of panels 28 and 29.

In one example, a selection of rolls of template strip material is made available to a framer. In this selection, there is a roll that bears nail markings for each nailing pattern to be used in the framing of a building. The framer uses a set of constructions plans, identifies from the construction plans the pattern of nailing specified for a particular shear wall, selects the associated roll whose marks 14 and 15 identify that nailing pattern, and then fixes strips of the template tape as illustrated in FIG. 2. The framer works around a building being framed in this manner, attaching the proper types of templates. The templates are then used as guides in the subsequent nailing process so that the nailing schedule as specified on the construction plans is followed. The non-structural template tape material remains in place after nailing so that a subsequent inspection of the nailing is made easier. The non-structural template tape material is made from an inexpensive material so that using the template material does not add an undesirably large amount of material cost to the building. The non-structural template tape material is made of a material that can be readily pierced by nails and staples so that the presence of the in-situ template does not interfere with subsequent attachment of materials to the nailed surface of the finished shear wall.

Although certain specific exemplary embodiments are described above in order to illustrate the invention, the invention is not limited to the specific embodiments. In one embodiment, the nailing markings are actually small holes in the template tape material. Although an example of a shear wall nailing template is described above that is less than eight inches wide, a shear wall template in some novel embodiments is wider than eight inches and includes nailing markings usable for nailing a sheathing panel to two different parallel extending wall studs that are disposed at a distance (for example, twelve or sixteen inches) from one another. The template may, for example, be a sheet that covers the entire surface area of a four foot by eight foot sheathing panel. Accordingly, various modifications, adaptations, and combinations of various features of the described embodiments can be practiced without departing from the scope of the invention as set forth in the following claims.

What is claimed is:

1. A method, comprising:

(a) fixing a template tape to a shear wall under construction, wherein the shear wall under construction includes a frame member and a sheathing panel, wherein the template tape bears a pattern of nailing pattern markings, wherein the template tape is at least five feet in length and is more than one inch wide and is less than eight inches wide; and (b) driving a different nail through each different marking of the pattern such that each nail passes through the template, then through the sheathing panel, and then into the frame member, wherein the template tape is non-structural.

2. The method of claim 1, wherein the pattern of nailing pattern markings is a field pattern, wherein the template tape further includes a second pattern of nailing pattern markings, wherein the second pattern of nailing pattern markings is an edge pattern.

3. The method of claim 1, further comprising:

(c) separating a length of template tape from a roll of template tape, wherein the separated length is the template tape fixed in (a), and wherein the roll of template tape has a length of at least three hundred feet.

4. The method of claim 3, wherein the length of template tape is separated in (c) by ripping the length of template tape from the roll by hand without the use of any cutting implement.

5. The method of claim 3, wherein the roll weighs less than one hundred sixty ounces (five pounds), and wherein the template tape is not a strip of structural metal.

6. The method of claim 1, wherein the template tape comprises a layer of adhesive.

7. The method of claim 1, wherein the pattern is of a nailing pattern type, wherein template tape bears lettering, and wherein the lettering is indicative of the nailing pattern type.

8. The method of claim 1, wherein the template tape bears a lengthwise centerline, wherein at least some of the nailing pattern markings are off-center from the lengthwise centerline.

9. The method of claim 1, wherein the template tape bears instructions on how to use the template tape in the construction of a shear wall.

10. A roll of a length of non-structural template tape, wherein the template tape bears a pattern of nailing pattern markings, wherein the template tape bears a lengthwise centerline, wherein at least some of the nailing pattern markings are off-center from the lengthwise centerline, wherein the template tape is more than one inch wide and is less than eight inches wide, wherein the length is at least one hundred feet, and wherein the roll weighs less than one hundred sixty ounces (five pounds).

11. The roll of claim 10, wherein the template tape bears nailing instructions.

12. The roll of claim 10, wherein the pattern is of a nailing pattern type, wherein template tape bears lettering, and wherein the lettering is indicative of the nailing pattern type.

13. A non-structural shear wall nailing template, wherein the template bears a pattern of shear wall nailing pattern markings, wherein the template has a dimension that is greater than five feet, and wherein the template is a flexible non-metallic sheet.

14. The non-structural shear wall nailing template of claim 13, wherein the pattern is of a nailing pattern type, wherein template bears lettering, and wherein the lettering is indicative of the nailing pattern type.

15. The non-structural shear wall nailing template of claim 13, wherein the template comprises an adhesive layer.

16. The non-structural shear wall nailing template of claim 13, wherein the template includes lettering that includes the terms "field" and "edge".

17. The non-structural shear wall nailing template of claim 13, wherein the pattern is a field nailing pattern, wherein the template further includes a second pattern, wherein the second pattern is an edge nailing pattern.

18. The non-structural shear wall nailing template of claim 13, wherein the dimension that is greater than five feet is a length, wherein the template has a width is that less than eight inches.

19. The non-structural shear wall nailing template of claim 13, wherein the template is fixed to a shear wall at least in part by a nail, the nail extending through the template, through a sheathing panel, and into a framing member.

20. The non-structural shear wall nailing template of claim 13, wherein the dimension that is greater than five feet is also greater than one hundred feet, and wherein the template is in the form of a roll.

21. A method, comprising:

(a) fixing a template tape to a shear wall under construction, wherein the shear wall under construction includes a frame member and a sheathing panel, wherein the template tape bears a pattern of nailing pattern markings; and (b) driving a different nail through each different marking of the pattern such that each nail passes through the template, then through the sheathing panel, and then into the frame member, wherein the template tape is non-structural.

22. A method, comprising:

(a) fixing a template tape to a shear wall under construction, wherein the shear wall under construction includes a frame member and a sheathing panel, wherein the template tape bears a pattern of nailing pattern markings, wherein the pattern is of a nailing pattern type, wherein template bears lettering, and wherein the lettering is indicative of the nailing pattern type, wherein the template tape is at least five feet in length and is more than one inch wide and is less than eight inches wide; and (b) driving a different nail through each different marking of the pattern such that each nail passes through the template, then through the sheathing panel, and then into the frame member, wherein the template tape is non-structural.

23. A non-structural shear wall nailing template, wherein the template bears a pattern of shear wall nailing pattern markings, wherein the template tape bears a lengthwise centerline, wherein at least some of the nailing pattern markings are off-center from the lengthwise centerline, wherein the template has a dimension that is greater than five feet, and wherein the template is a flexible non-metallic sheet.

* * * * *